US007786675B2

(12) United States Patent
Yakovlev et al.

(10) Patent No.: US 7,786,675 B2
(45) Date of Patent: Aug. 31, 2010

(54) FAST FERROELECTRIC PHASE SHIFT CONTROLLER FOR ACCELERATOR CAVITIES

(75) Inventors: Vyacheslav P. Yakovlev, Hamden, CT (US); Sergey Y. Kazakov, Ibaraki-ken (JP); Jay L. Hirshfield, Hamden, CT (US)

(73) Assignee: Omega-P, Inc., New Haven, CT (US)

( * ) Notice: Subject to any disclaimer, the term of this patent is extended or adjusted under 35 U.S.C. 154(b) by 678 days.

(21) Appl. No.: 11/785,058

(22) Filed: Apr. 13, 2007

(65) Prior Publication Data

US 2008/0024065 A1 Jan. 31, 2008

Related U.S. Application Data

(63) Continuation-in-part of application No. 11/600,920, filed on Nov. 17, 2006.

(60) Provisional application No. 60/737,420, filed on Nov. 17, 2005.

(51) Int. Cl.
*H05H 7/22* (2006.01)

(52) U.S. Cl. ..... 315/5.39; 315/5.41; 315/505

(58) Field of Classification Search ..... 315/5.38, 315/5.39, 5.41, 5.42, 500, 502, 504, 501, 315/503, 505

See application file for complete search history.

(56) References Cited

U.S. PATENT DOCUMENTS 4,713,581 A * 12/1987 Haimson ..... 315/5.41

6,407,505 B1 * 6/2002 Bertsche ..... 315/5.41

OTHER PUBLICATIONS

International Linear Collider Technical Review Committee, 2nd Report, SLAC-R-606, SLAC2003, (526 pgs.).

International Linear Collider Reference Design Report, Feb. 2007, (217 pgs.).

"Optimal RF Systems for Lightly Loaded Superconducting Structures", Zwart et al, *Proceedings of the 2004 FEL Conference*, pp. 542-545. See also web.elettra.trieste.it/feI2004/proceedings/papers/TUPOS57/TUPOS57.pdf.

"First Demonstration of Microphonic Control of a Superconducting Cavity with a Fast Piezoelectric Tuner", SIMROCK et al, *Proceedings of the 2003 Particle Accelerator Conference*, pp. 470-472.

"Microphonics Detuning in the 500 MHz Superconducting CESR Cavities", Liepe et al, *Proceedings of the 2003 Particle Accelerator Conference*, pp. 1326-1328.

(Continued)

*Primary Examiner*—David Hung Vu
(74) *Attorney, Agent, or Firm*—Arent Fox LLP

(57) ABSTRACT

The present invention relates to methods and systems for fast ferroelectric tuning of RF power used in a particle accelerating system. By adjusting the voltages fed to the ferroelectric phase shift controller, the amplitude and phase of the RF power wave are altered, thus changing the coupling of the power generating circuit and the superconducting cavity. By altering this coupling rapidly, maximum power transfer efficiency can be achieved, which is important given the large amounts of power shunted through the particle accelerating system. In one embodiment, the ferroelectric tuner is optimally made of a magic-T waveguide circuit element and two phase shifters, although other implementations of the system may be utilized. Alternative phase shifters are shown.

20 Claims, 16 Drawing Sheets

OTHER PUBLICATIONS

"Reactive RF Tuning for Compensation of a Detuned Accelerating Cavity", Kang et al, *Proceedings of LINAC 2002*, pp. 733-735.

"External Tuner", DOHLUS, *Deutsches Electromen Synchrotron*, Feb. 2004, 1 page.

"First Results with a Fast Phase and Amplitude Modulator for High Power RF Application", Valuch et al, *Proceedings of EPAC 2004*, pp. 959-961.

"Fast-Ferrite Tuner Operation on a 352-MHz Single-Cell RF Cavity at the Advanced Photon Source", Horan et al, *Proceedings of the 2003 Particle Accelerator Conference*, pp. 1177-1179.

"High Power Phase Shifter", Foster et al, *Proceedings of 2005 Particle Accelerator Conference*, pp. 3123-3125.

"1.3 GHz Electrically-Controlled Fast Ferroelectric Tuner", Yakovlev et al, *Proceedings of EPAC 2006*, pp. 487-489.

"New Developments on Low-Loss Ferroelectrics for Accelerator Applications", Kanareykin et al, *Proceedings of EPAC 2006*, pp. 3251-3253.

Final International Technology Recommendation Panel Report, Sep. 2004, (33 pgs.). www.final.gov/directorate/icfa/ITRP Report Final.pdf.

"Fast Ferroelectric L-band Tuner", Kazakov et al, 12$^{th}$ *Advanced Accelerator Concepts Workshop* (*AAC2006*), pp. 331-338. See also http://www.hep.anl.gov/aac06/.

"New Low-Loss Ferroelectric Materials for Accelerator Applications", Kanareykin et al, *AAC2004 Proceedings*, pp. 1016-1024.

"Fast Switching Ferroelectric Materials for Accelerator Applications", Kanareykin et al, 12$^{th}$ *Advanced Accelerator Concepts Workshop* (*AAC2006*), pp. 311-319.

"Fast X-Band Phase Shifter", Yakovlev et al, *AAC2004 Proceedings*, pp. 643-650.

"Non Linear Effects in Ferrite Tuned Cavities", Goren et al, *PAC 1993 Proceeding*, pp. 877-879.

"Applications of Ferroelectrics in Military Systems", Webb, *IMS 2000*, (19 pgs.) See also http://my.ece.ucsb.edu/yorklab/Projects/Ferroelectrics/IMS2000%20Workshop/WFE004.pdf.

"Bulk Ceramic Ferroelectrics and Composites: Manufacture, Microwave Properties and Applications", Sengupta, *IMS2000*, (47 pgs.). See also http://my.ece.ucsb.edu/yorklab/Projects/Ferroelectrics/IMS2000%20Workshop/WFE002.pdf.

* cited by examiner

FAST FERROELECTRIC PHASE SHIFT CONTROLLER FOR ACCELERATOR CAVITIES

This application is a continuation-in-part application of application Ser. No. 11/600,920 filed Nov. 17, 2006 and claims priority thereto. In addition, this application through application Ser. No. 11/600,920 claims priority to U.S. Provisional Patent Application No. 60/737,420, filed on Nov. 17, 2005. The entirety of these prior applications are hereby incorporated by reference.

BACKGROUND OF THE INVENTION

1. Field of the Invention

This invention relates to a fast, externally-controlled ferroelectric phase shift controller for coupling control of microwave cavities, including, but not limited to those used in linear colliders, superconducting linear and circular accelerators, energy recovery linacs (ERLs) for free electron lasers and ion coolers, superconducting RF systems of circular accelerators and storage rings, and other particle accelerators, and the methods and systems required to carry out ferroelectric tuning and phase shift adjustment.

2. Background of the Technology

Currently, experiments involving sub-atomic particles generally take place using energetic beams generated in particle accelerators. Particle accelerators generally fall into one of two groups: linear particle accelerators and circular particle accelerators. In a linear particle accelerator, particles are accelerated in a straight line, with a target of interest at one end. In a circular particle accelerator, particles move in a circle until they reach sufficient energy. Circular particle accelerators have an advantage over linear accelerators in that the ring topology allows continuous acceleration without an end. Currently, the largest linear particle accelerator is the Stanford Linear Accelerator (SLAC), which is 3 kilometers long. The largest circular particle accelerator, by contrast, has a circumference of 26.6 kilometers.

A need exists in the art for fast ferroelectric components that control reactive power for fast tuning of cavities of superconductors utilized in particle accelerators, such as those to be used, for example, in the superconducting Energy Recovery Linac (ERL). This need will continue as the next generation of particle accelerators is constructed, for example, the International Linear Collider (ILC), which should fulfill the well recognized need in the art for a linear $e^+e^-$ (electron-positron) collider with a center-of-mass energy $E_{cm}$ between 0.5 and 1.0 TeV.

Further, fast electrically-controlled coupling is desirable for linear accelerators in order to match the cavity with the feeding transmission line as the beam load varies. Fast electrically-tuned amplitude and phase control with a feedback system is useful in order to be able to compensate for possible phase deviations of the input RF fields in each cavity. In a linear accelerator, RF fields in all cavities must have precisely-fixed phase differences with respect to one another, plus uniform amplitudes. As an example, this is especially critical for the proposed ILC design, which requires each klystron to drive 36 separate cavities.

The proposed ILC design specification is presented herein as an example of a superconducting linear accelerator which utilizes the ferroelectric phase shift controller of the present invention. This design is merely presented as one example of the type of particle accelerator that can be utilized in conjunction with an embodiment of the present invention. One skilled in the art will recognize that the present invention could be utilized in any number of particle accelerators, or in other applications which require fast phase shifting of RF power.

In 2004, the International Committee for Future Accelerators (ICFA) formed the International Technology Recommendation Panel (ITRP) to evaluate and recommend technology for the future ILC. In September 2004, the ITRP selected the superconducting RF power technology as utilized in TESLA, which accelerates beams in 1.3 GHz (L-Band) superconducting cavities. In the selected concept, two main linear accelerators, each including approximate 10,000 one-meter long nine-cell superconducting cavities, will be used. Groups of 12 cavities will be installed in a common cryostat. The accelerating gradient is about 25 MeV/m and the center of mass energy is 500 GeV. The RF power is generated by about 300 klystrons per linear accelerator, each feeding 36 9-cell cavities. The required peak power per klystron is about 10 MW, including a 10% overhead for correcting phase errors during the beam pulse which arise from Lorentz force detuning and microphonics. The RF power pulse length is 1.37 ms, which includes a beam pulse length of 950 μs, and a cavity fill time of 420 μs. The repetition rate is 5 Hz. The average mains power consumed by the system at 500 GeV center-of-mass energy is thus about 70 MW, assuming an RF power source efficiency of approximately 65%, and a modulator efficiency of about 85%. Refrigerators used to cool the structure will require an additional 8.5 MW, to dissipate heat from RF power losses in the structures.

In order to successfully power the design, there is a need in the art for an external fast phase shift controller which will allow quick extraction of RF power from the superconducting sections after the RF power pulse ends, thereby decreasing the cavity heating and the refrigerator power consumption.

Ferrite tuners were originally suggested for this application, such as those being developed at CERN for the Superconducting Proton Liner Accelerator. These tuners are designed to provide fast phase and amplitude modulation of the drive signal for individual superconducting cavities. The tuner is based on two fast and compact high-power ferrite phase shifters magnetically biased by external coils. However, the tuning frequency for this device has an upper cut-off at 2 kHz that comes mainly from the remaining eddy currents inside the RF power structure. Thus, its shortest switching time is about 1 millisecond. For applications such as those discussed above, switching times must not exceed 50-100 microseconds. Accordingly, there is a need in the art for faster ferroelectric phase shift controller.

There is a further need in the art for an external fast phase shift controller which will stabilize the necessary precise phase differences between cavities in near-real-time. This compensates for fluctuations in the phase difference in each cavity due to microphonics and Lorentz-force cavity distortions.

Recently, ferroelectric devices for fast switching applications have received close attention, and are already used in low- to moderate-power military and communications systems as fast tunable components, because they have the ability to operate up to frequencies above 30 GHz with reasonably low loss, and have high intrinsic tuning rates. Ferroelectrics have an E-field-dependent dielectric permittivity $\in(E)$ that can be very rapidly altered by application of a bias voltage pulse. The switching time in most instances would be limited by the response time of the external electronic circuit that generates and transmits the high-voltage pulse. The minimal switching time achieved in operating devices is less than one nanosecond. There is accordingly a need in the art for a ferroelectric material with good working properties for use in high-power RF switches for linear collider applications.

SUMMARY OF THE INVENTION

The present invention is directed to a fast electrically-controlled ferroelectric phase shift controller for use in particle accelerators, such as the proposed International Linear Collider (ILC), or the Energy Recovery Linac (ERL), for example. The phase shifter will allow coupling changes during the cavity filling process in order to provide significant power savings, and will allow for fast stabilization against phase fluctuations.

The present invention is directed to a system for controlling a particle accelerating device with klystrons for generating RF power for use by the particle accelerating device, and delivery systems for delivering the RF power from the klystrons to the superconducting cavities which perform the acceleration of the particles for the experiments. The delivery systems are composed of a circulator for receiving RF power, which is operatively coupled to a ferroelectric phase shift controller, which receives the RF power from the circulator, and modifies various characteristics of the RF power depending on the implementation of the ferroelectric phase shift controller. The RF power then flows through a waveguide transformer which transfers the power to the superconducting cavities, where the RF power accelerates particles in the superconducting cavities, allowing high-speed particle collision. The ferroelectric phase shift controller modifies the operative coupling of the waveguide transformer and the superconducting cavities by adjusting, for example, the phase of the RF power. The ferroelectric phase shift controller can be comprised of two phase shift controllers and a magic-T waveguide circuit element.

The present invention is also directed to a method for controlling a coupling between the circuit which delivers the RF power and a superconducting cavity, during a filling of the superconductor cavity. The method includes determining a nominal coupling value for the coupling between the circuit and the superconducting cavity, changing the coupling between the circuit and the superconducting cavity by increasing an actual coupling value by a multiple of the nominal coupling value via a ferroelectric phase shift controller, prior to the filling of the superconductor cavity. During the filling of the superconductor cavity, the actual coupling value is reduced back to the nominal coupling value. Before the next filling of the superconductor cavity, the actual coupling value is re-raised to a multiple of the nominal coupling value.

BRIEF DESCRIPTION OF THE FIGURES

In the drawings:

FIG. 12(*b*) illustrates the field pattern of an impedance transformer according to an embodiment of the present invention;

FIG. 12(*c*) illustrates the calculated reflection magnitude over the impedance transformer according to an embodiment of the present invention;

DETAILED DESCRIPTION

In one embodiment of the linear accelerator, for a center of mass energy of 500 GeV, for example, about 600 RF power stations in the main linear accelerators are required in order to provide RF power for all the accelerating cavities. The RF power distribution is based on two symmetrical systems, using a linear system branching off identical amounts of power for each cavity from a single line by means of directional couplers. This system most closely matches the linear tunnel geometry. The system is also preferable to a tree-like distribution system because long parallel waveguide lines can be avoided, thus leading to lower waveguide losses.

Figure 1:
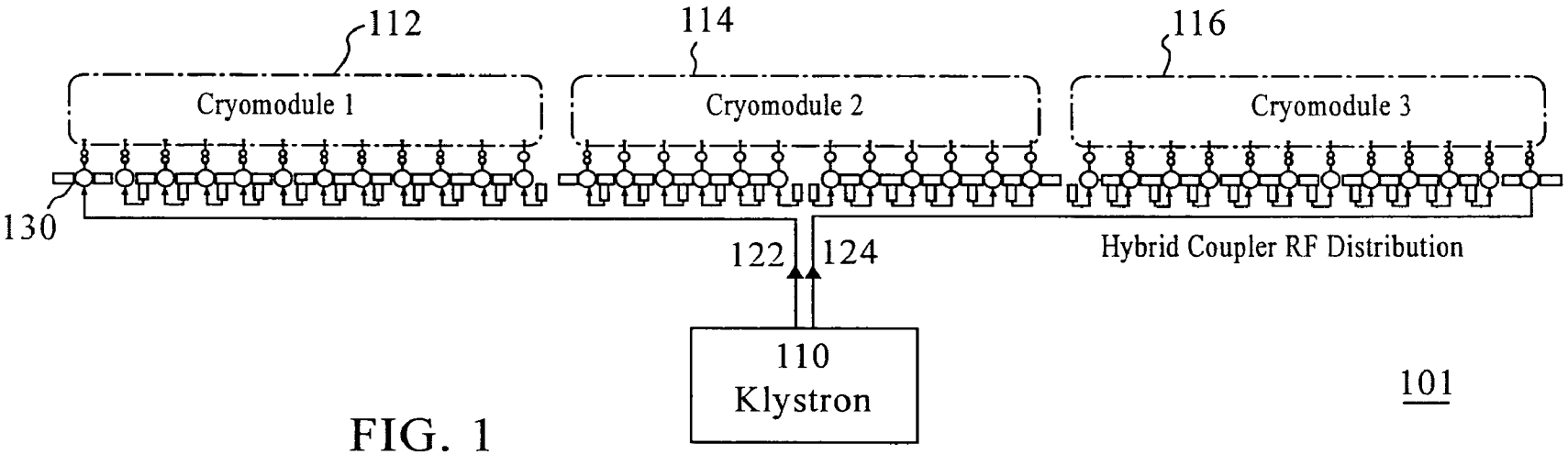
FIG. 1 shows a layout of an RF station for use in conjunction with an embodiment of the present invention.

As illustrated in FIG. 1, at each RF power station 101, three cryomodules 112, 114, and 116 are fed by a klystron 110, in order to provide an accelerating gradient. The klystron 110 has two RF power output windows 122 and 124 which supply the thirty six power cavities, for example power cavity 130, shown in more detail in FIG. 2. In a preferred embodiment of the present invention, the cryomodules are fed by a 10 MW klystron, providing an accelerating gradient of 23 MeV/m, however the invention is not limited to this embodiment and other types of klystrons or other high-power microwave amplifiers such as magnicons could be substituted or utilized by one experienced in the art.

Figure 2:
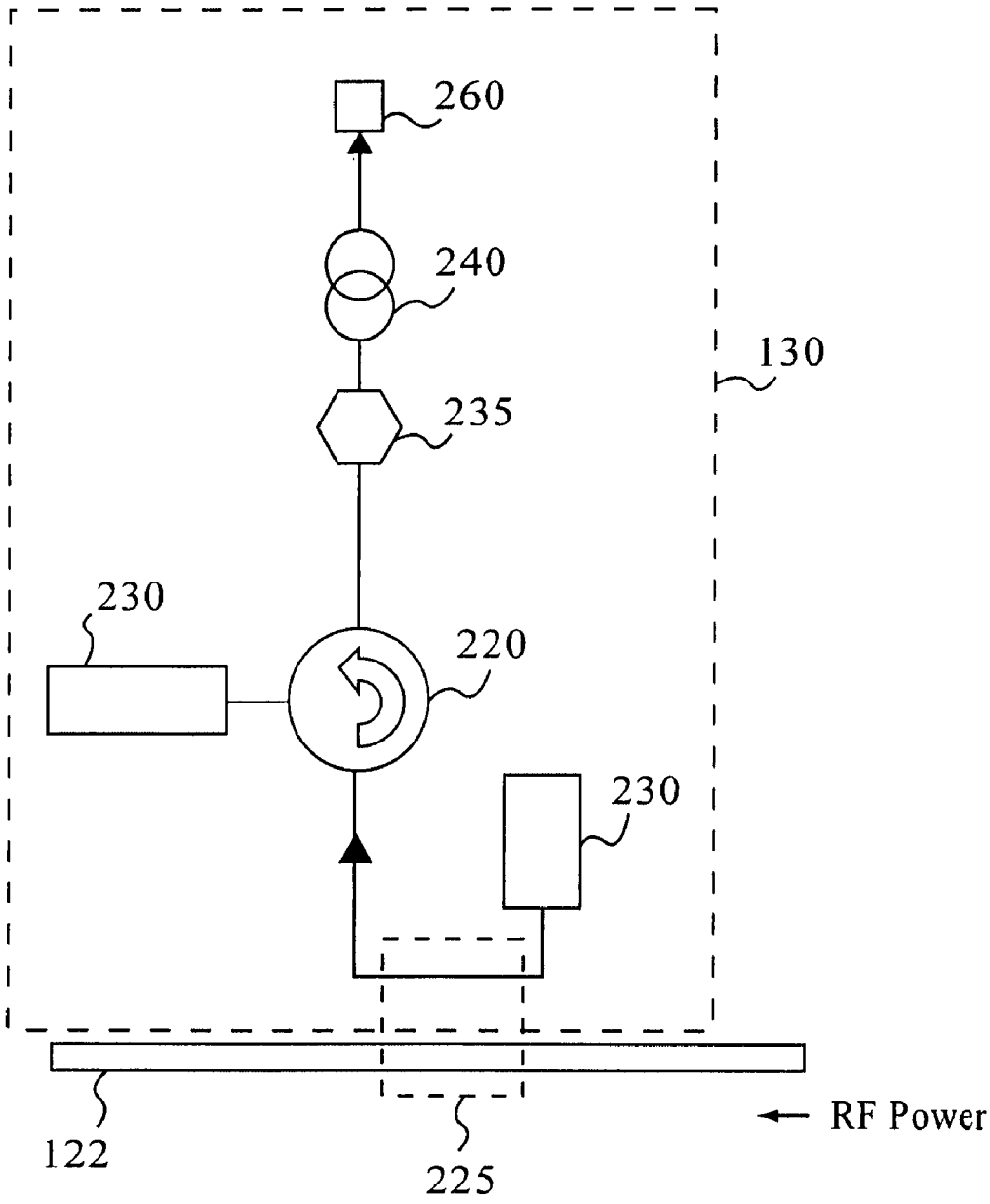
FIG. 2 illustrates a schematic of a coupling in conjunction with an embodiment of the present invention.
Figure 3:
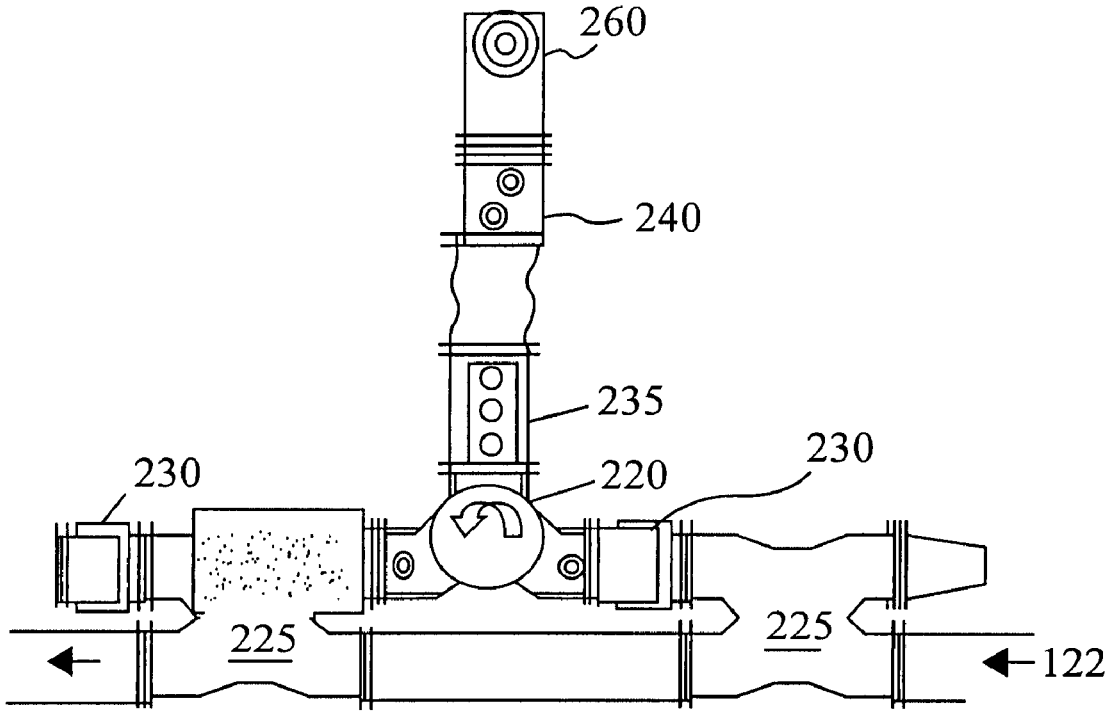
FIG. 3 illustrates a diagram of the coupling shown in FIG. 2 in an embodiment of the present invention.

FIG. 2 provides a schematic diagram of the functionality of power cavity 130, and FIG. 3. provides a detailed diagram of an implementation of one embodiment of the present invention. An RF power output pulse flows through the RF power output chamber 122 from the klystron 110 (not shown). The pulse passes through hybrid coupler 225 and into the circulator 220. The circulator 220 protects the klystron against reflected power at the start of the RF power pulse, during filling time of the cavity, and at the end of the pulse. From the circulator 220, the RF power travels through the ferroelectric phase shift controller 235, which will be discussed in more detail further herein. The RF power is then boosted by the waveguide transformer 240 and travels into the cavity input coupler 260, which fills the cavity during the RF power pulse.

Figure 4:
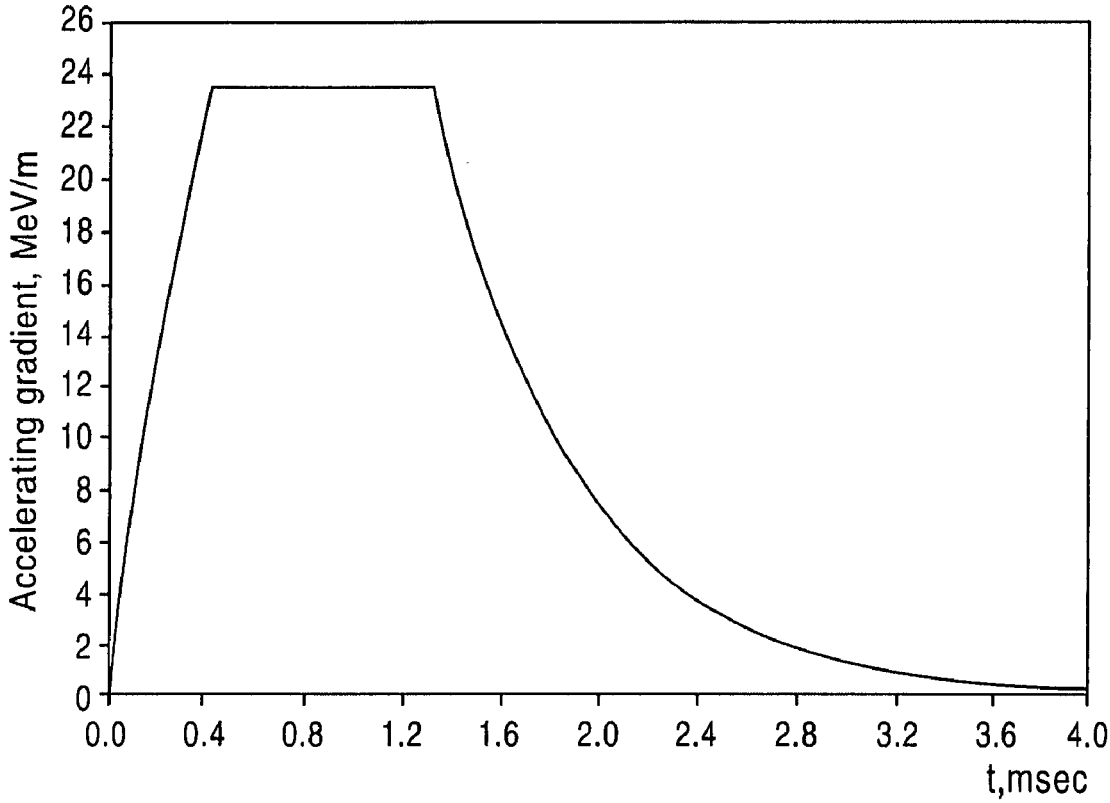
FIG. 4 illustrates the idealized accelerating gradient in the cavity over time.

In a preferred embodiment of the present invention, the particle beam pulse consists of 2820 micro-pulses spaced by 0.337 microseconds, resulting in a macro-pulse duration of 950 microseconds. To fill the cavity with RF power, an additional 420 microseconds is needed. Accordingly, the total the RF power pulse length is 1.37 milliseconds. The idealized pulse shape of the cavity RF power field is shown as FIG. 4. The RF power pulse includes the cavity filling time, the acceleration interval, and the cavity discharge after the klystron pulse ends. The filling time $t_f$ is related to the cavity time constant $\tau_c$ as $$t_f=\tau_c \ln[2\beta/(\beta-1)] \quad (1)$$

where $\beta$ is the coupling coefficient, defined as $\beta=P_{in}/P_{diss}$, with $P_{in}$ the input power and $P_{diss}$ the power dissipated in the cavity walls. In a preferred embodiment of the present invention, the quality factor Q is about $10^{10}$, the dissipated power is 2 kW/station (for an accelerating gradient of 23 MeV/m) and $\beta\approx4200$. Here, $t_f\approx\tau_c \ln 2$. The efficiency $\eta$ of cavity filling is given by $$\eta=W/P_{in}t_f=\tfrac{1}{2}\ln 2\approx72\%, \quad (2)$$

where W is the energy stored in the cavities at the end of the filling process. About 30% of the input power is reflected. The energy $W_f$ dissipated in the cavities during the filling time is $$W_f=4P_{diss}t_f[1-\tfrac{5}{8}\ln 2]; \quad (3)$$

the energy $W_{acc}$ dissipated during acceleration is $$W_{acc}=P_{diss}t_{acc}, \quad (4)$$

where $t_{acc}$ is beam macro-pulse duration; and the energy $W_{disch}$ dissipated during discharge of the cavities is $$W_{disch}=P_{diss}\tau_c/2=P_{diss}t_f/2\ln 2. \quad (5)$$

According to Equation 5, the total average power dissipation in the entire collider at a repetition rate of 5 Hz is 8.5 kW.

Cryogenic refrigerators have an efficiency of about 1 kW/W at a temperature of 2° K., so the power required for the refrigerator is roughly 8.5 MW in order to compensate RF power losses in the cavities. About 12% of the losses take place during the cavity filling, 67% during acceleration and 21% during the cavity discharge.

Utilization of fast coupling control during the cavity filling process will allow a reduction in the filling time. Before the pulse starts, the coupling should be higher than nominal, and in the end of filling it should be equal to the nominal value. The minimum possible filling time is $t_{min}=W/P_{in}=\tau_c/2=302$ μs, that gives an RF power savings of 9%. If the coupling is increased again after the RF power pulse ends, the power required will be reduced by as much as 21%. The total AC power saving can be as high as 8 MW. This would represent a significant savings in operating cost.

Figure 5:
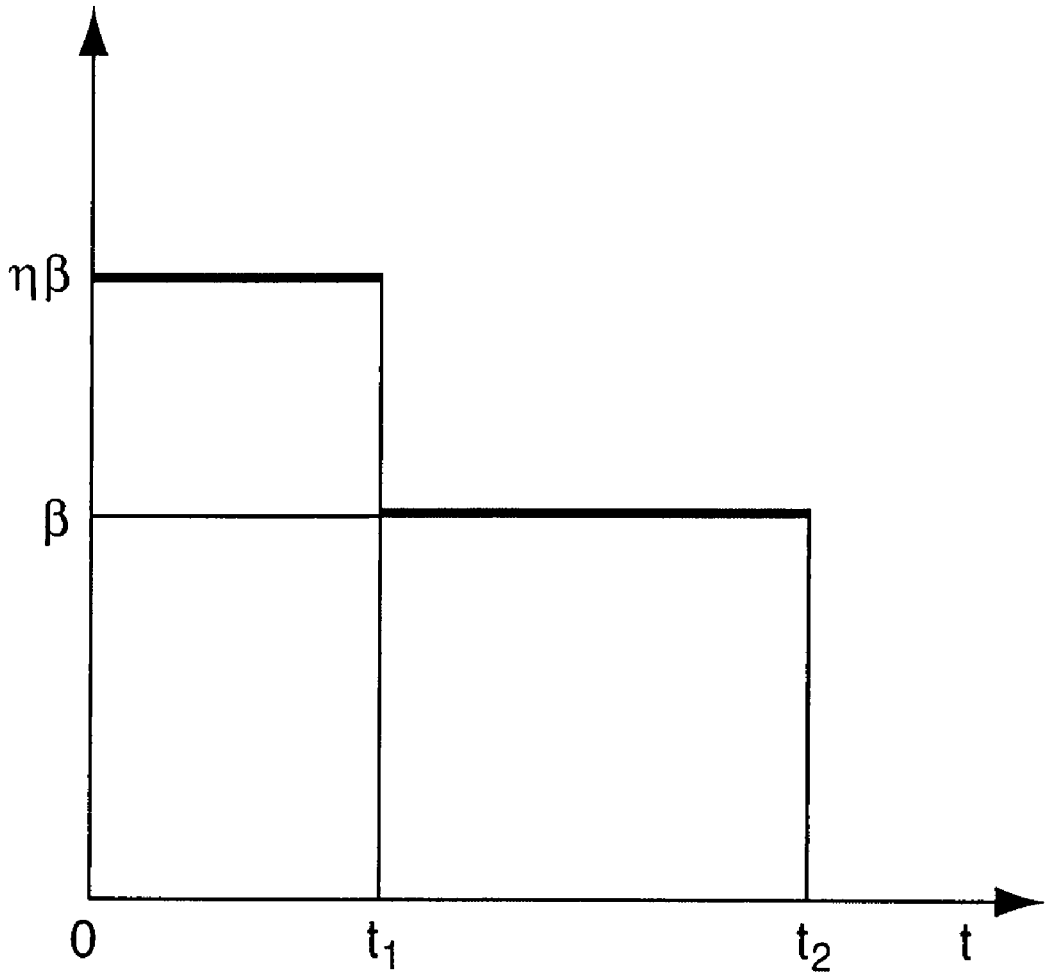
FIG. 5 illustrates the timing of the coupling change during the cavity filling process.

In a preferred embodiment of the present invention, the coupling is initially n times higher than the nominal value (n>1), and is then reduced to nominal during the filling process, as shown in FIG. 5. In FIG. 5, $n\beta$ is the initial coupling that is changed instantaneously at $t=t_1$ to the nominal value of coupling $\beta$. The RF power pulse starts at t=0 and ends at $t=t_2$.

Figure 6:
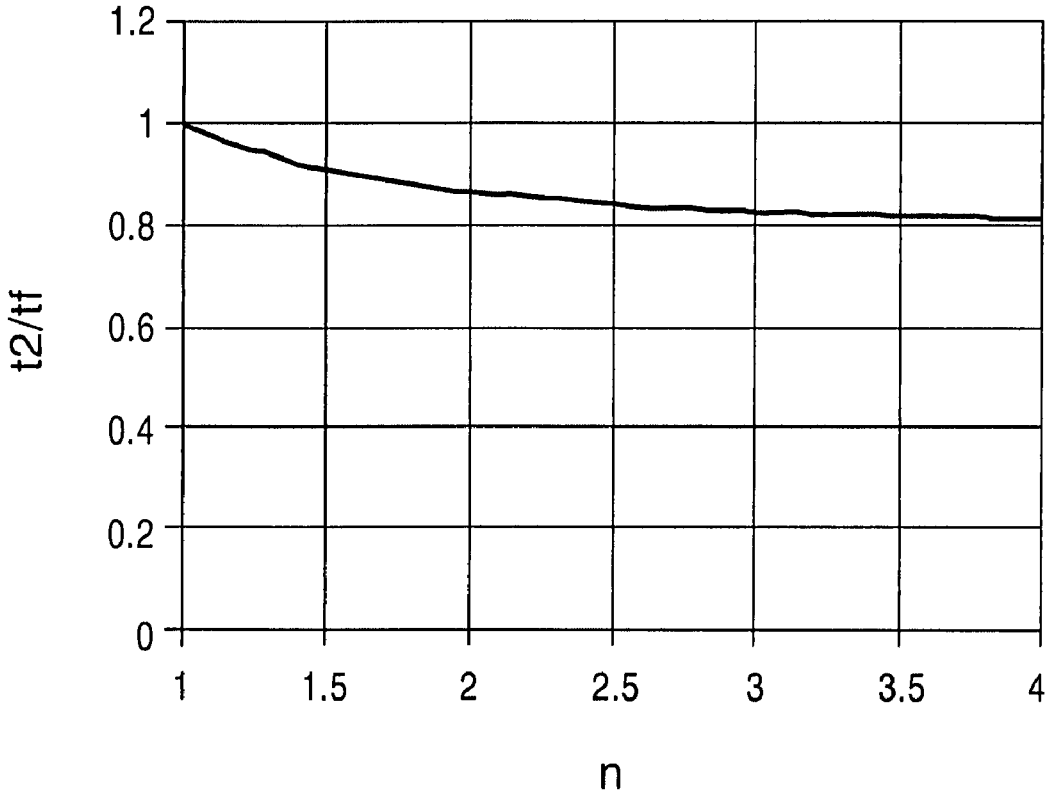
FIG. 6 illustrates filling time dependence versus the initial coupling value.

FIG. 6 illustrates the relative filling time of the cavity based on n for the example described above in FIG. 5. As illustrated, at n=4, the use of the fast ferroelectric phase shift controller reduces filing time by up to 20%. Further, if the coupling is increased again n times after the klystron pulse ends, the cavity discharge time will be reduced n times. The less time required to discharge the cavity, the less power must be used for refrigeration to prevent overheating.

As illustrated by this example, if initial coupling is four times higher than nominal coupling, this relatively simple algorithm for manipulating the coupling reduces the filling time by 18% from constant coupling. Equation 2 shows that, in an ideal case where there are no reflections during the filling time, the filling time would be reduced by 28% over the filling time for constant coupling. The double change of the coupling during the filling process allows further reduction of filling time, close to the theoretical limit of 302 microseconds.

Figure 7:
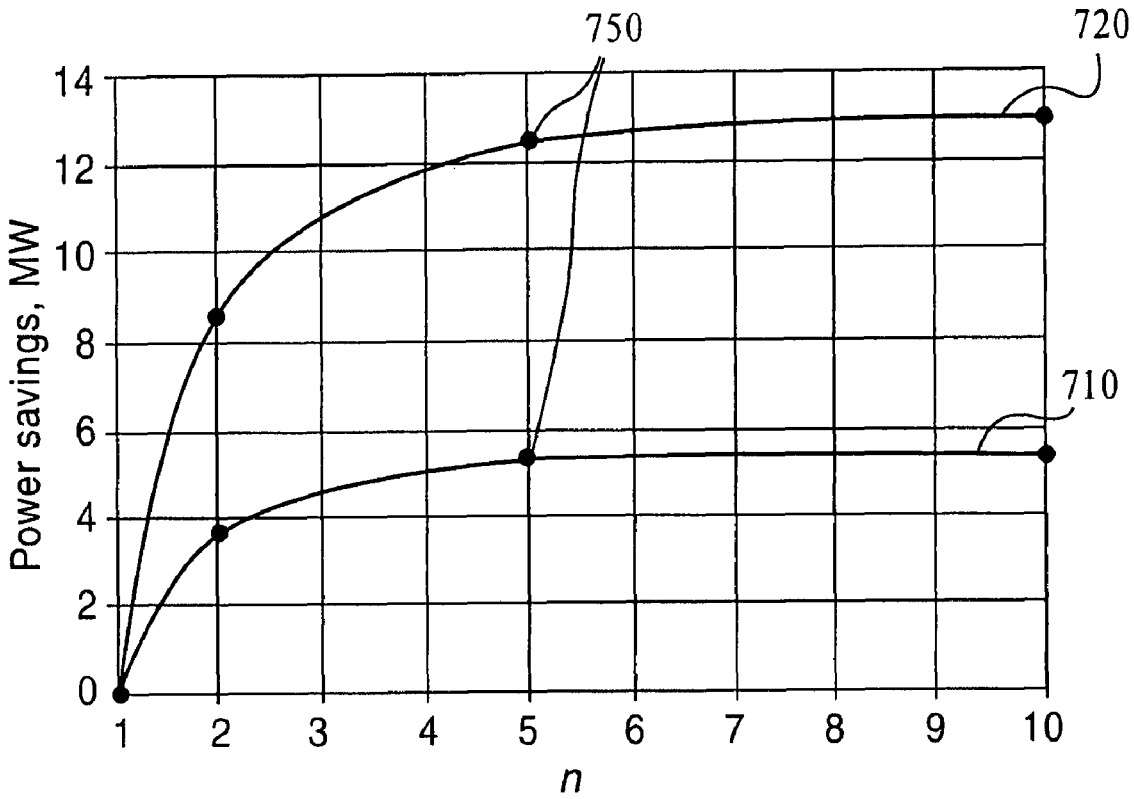
FIG. 7 illustrates the total power savings over n, the multiplier of the nominal coupling value.

FIG. 7 represents the total AC power savings as a function of n for an embodiment of the present invention in both a 500 GeV linear accelerator shown on line 710 and an 800 GeV linear accelerator shown on line 720, for the case of one change of coupling during the cavity filling and discharge. FIG. 7 shows that, at point 750, where n=5, increasing the initial coupling n does not significantly increase power savings. Accordingly, it is ideal that n be set to 5, though it is not necessary to provide proper functionality.

Figure 8:
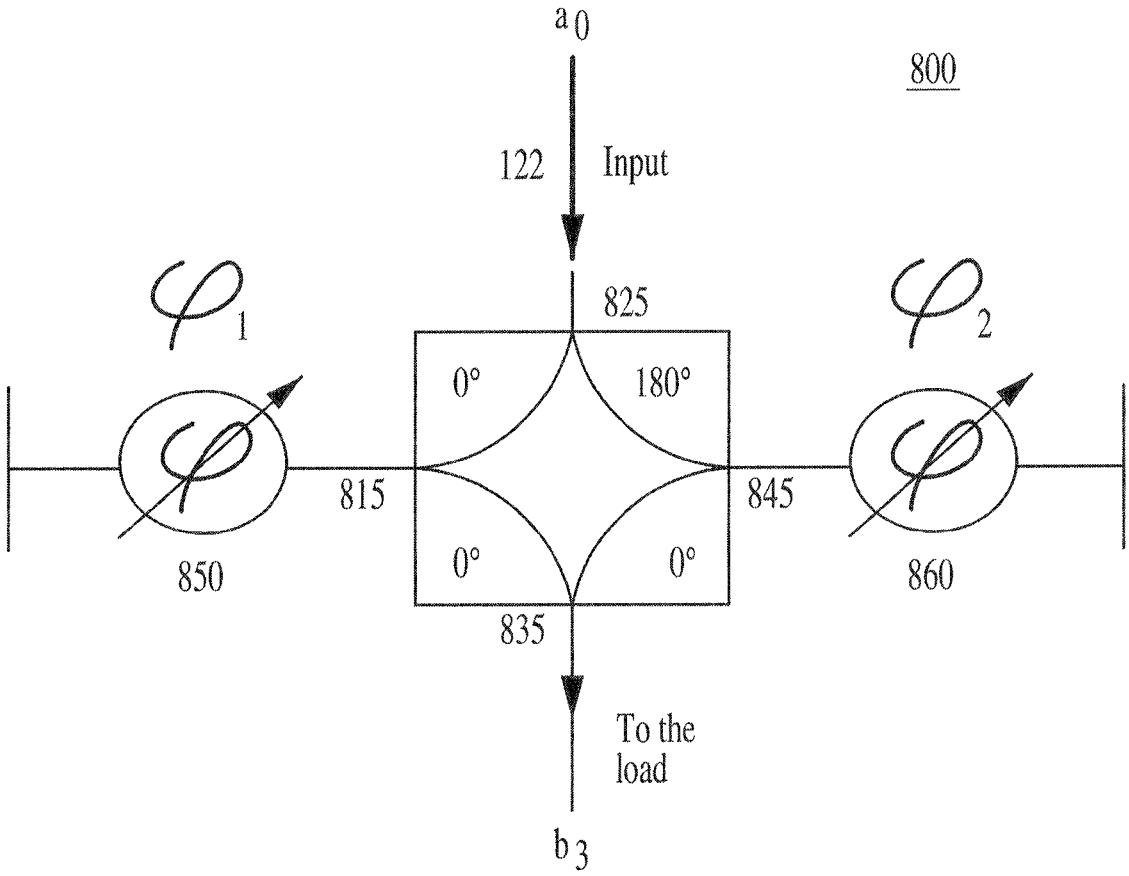
FIG. 8 illustrates a schematic of the fast ferroelectric tuning device in an embodiment of the present invention.
Figure 9:
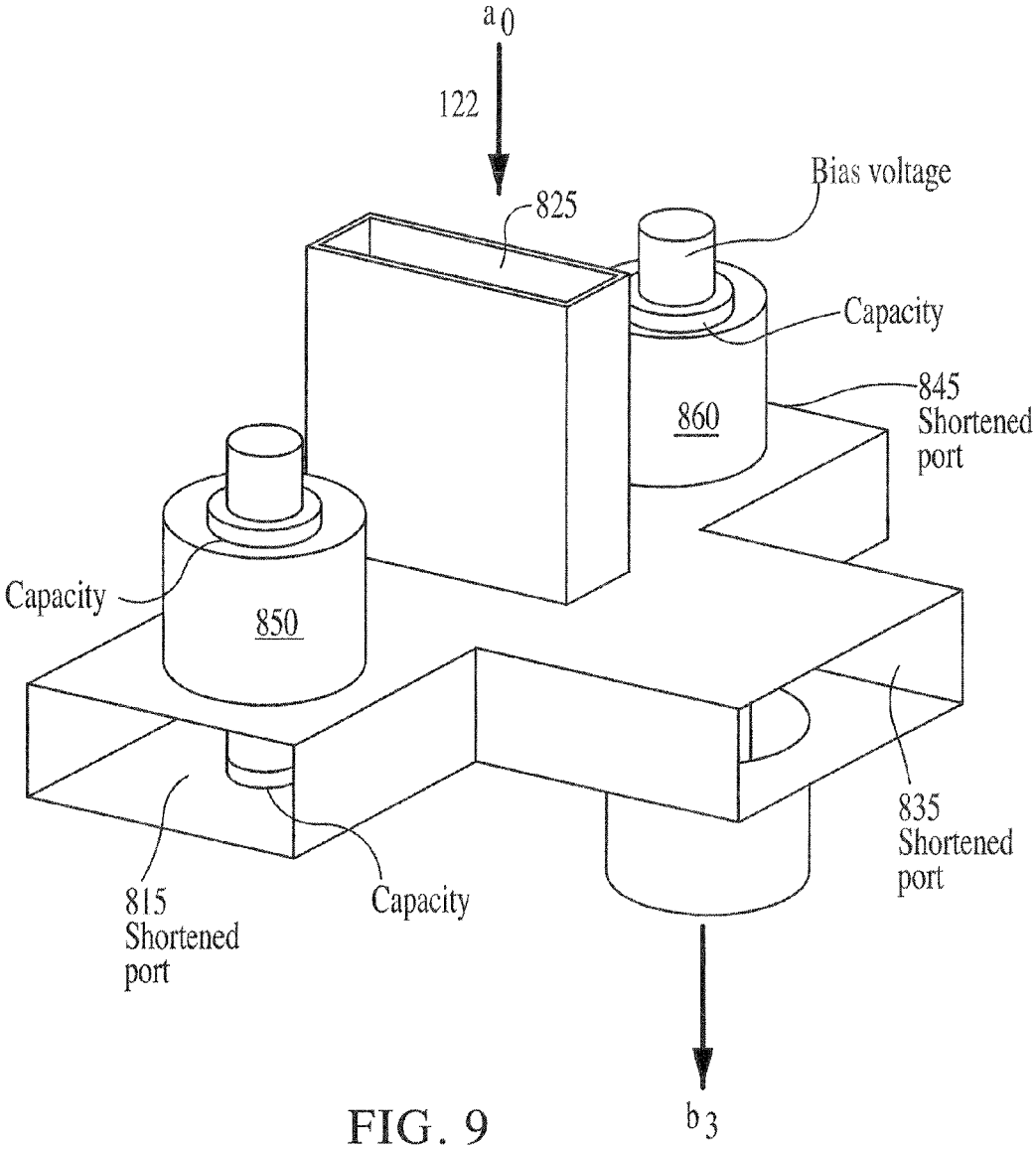
FIG. 9 illustrates a diagram of the fast ferroelectric tuning device in an embodiment of the present invention.

In one embodiment of the present invention, a fast ferroelectric phase shift controller provides fast electrically-controlled coupling and phase changes using a magic-T waveguide circuit element with two coaxial phase shifters 850, 860 containing ferroelectric elements. FIG. 8 is a schematic diagram of fast phase shift controller 800, and FIG. 9 illustrates a three-dimensional view of one embodiment of fast phase shift controller 800 implemented in a linear accelerator.

Fast phase shift controller 800 includes magic-T waveguide circuit element 810, and two phase shifters 850 and 860. Fast phase shift controller 800 can independently change both amplitude and phase of the transmitted wave. Magic-T waveguide circuit element 810 is matched and has the following S-matrix:

$$S=\frac{1}{\sqrt{2}}\begin{vmatrix}0 & 0 & 1 & 1\\ 0 & 0 & 1 & -1\\ 1 & 1 & 0 & 0\\ 1 & -1 & 0 & 0\end{vmatrix} \quad (6)$$

Magic-T waveguide circuit element 810 has four ports, 815, 825, 835, and 845. Ports 815 and 845 are connected to phase shifters 850 and 860, respectively. Phase shifters 850 and 860 are shorted at the other ends. Port 825 is connected to the RF power source input from RF power line 122. In a phase shifter connected as described above, the amplitude of the wave $b_3$ emitted from port 3 is described by the following equation:

$$b_3=ia_0\sin(\phi_1-\phi_2)e^{i(\phi_1+\phi_2)} \quad (7)$$

where $a_0$ is the amplitude of the input signal. If phase shifts $\phi_1$ and $\phi_2$ are adjusted from −90° to +90°, the transmission coefficient $b_3/a_3$ changes from 0 to 1, and the phase changes from −180° to 180°, independently.

Figure 10:
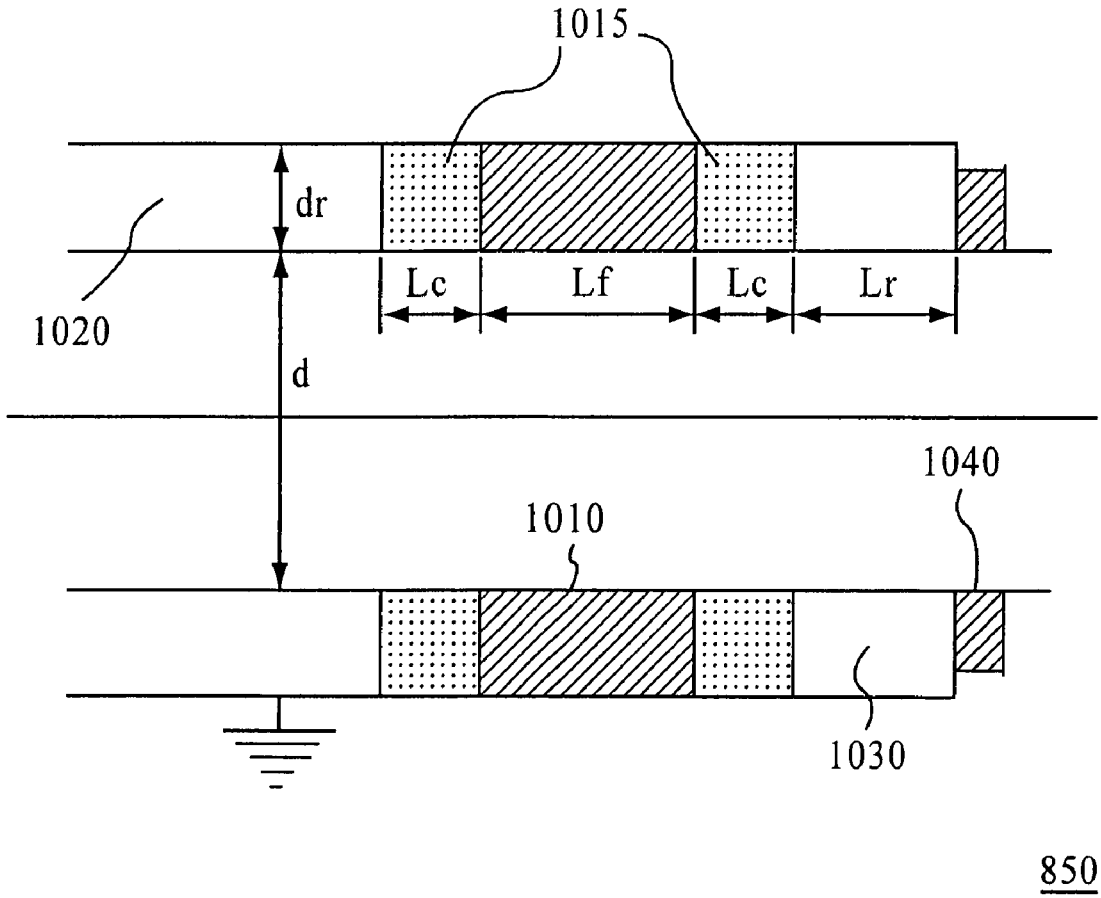
FIG. 10 illustrates a ferroelectric ring acting as a phase shifter in an embodiment of the invention.

In an embodiment of the present invention, phase shifters 850 and 860 may be designed as a coaxial line containing a half-wave ferroelectric ring 1010 with matching aluminum ring elements 1015, and terminated by a coaxial resonator 1030 and a coaxial capacitor 1040, as shown in FIG. 10. When the control system applies bias voltage between the center and outer matching aluminum rings 1015 of the coaxial line 1020, the dielectric permittivity of the ferroelectric ring 1010 changes, which causes a phase advance of the RF power wave in the phase shifter. This phase advance changes the coupling between the cavity and the RF power source.

In an embodiment of the present invention, the ferroelectric ring 1010 has a length Lf=20.95 mm and is surrounded by two identical alumina matching rings 1015 having lengths Lc=18.2 mm. The length of the end coaxial resonator 1030 is Lr=115 mm. The inner diameter of the coaxial line 1020 d=106 mm, and the gap between inner and outer conductor dr=2.8 mm. These numbers are provided merely as illustrations and are not intended to limit the invention to this specific embodiment. Different applications require the ferroelectric phase shift controller 800 to be built to different specifications.

In the conceptual design shown above, the phase shifter 850 should sustain a peak input power $P_{in}$ of 500 kW at a duty factor a of $6.5\cdot10^{-3}$, or an average power of 3.25 kW. For this high average power the temperature effects are important and will influence a final design. The average temperature rise ΔT in the ferroelectric ring 1010 in the coaxial phase shifter 850 operating in a magic-T 810, may be calculated from the formula $$\Delta T = \frac{1}{8}\left(\frac{a_f}{a}\right)^2 \frac{a\pi ZP}{Z_0\lambda K}\times\varepsilon\cdot tg\delta, \tag{8}$$

where $a_f/a$ is the ratio of the field amplitude in ferroelectric to the amplitude of the incident wave; Z is the line impedance, $Z=Z_0/2\tau\ln(1+2dr/d)$, $Z_0$ is vacuum impedance; P is the power of the incident wave, which in the present case is $P=P_{in}/2$ (see above); λ is the RF power wavelength in free space; $\in\approx500$ is ferroelectric permittivity; $tg\delta=4\times10^{-3}$ is the ferroelectric loss tangent. For the ferroelectric described herein, K≈7 W/m-° K. is the thermal conductivity of the ferroelectric. As evidenced by the above equation, in order to minimize the temperature rise, a low-impedance line is preferably used.

Although the described preferred embodiment utilizes a magic-T waveguide circuit element, the phase shift controller is not limited to this embodiment. The phase shift controller may be used with multiple different vector modulators, including, but not limited to three-stub tuners, 3-decibel hybrid vector modulators, and other applicable vector modulators.

In order to perform the above-mentioned system tuning, the ferroelectric materials must meet certain specifications. The relative dielectric permittivity ∈ should not exceed 300-500 to avoid problems in the switch design caused by interference from high order nodes. The dielectric permittivity should be able to change 20-40% to provide the required switching properties. The bias electric fields should be within 20-90 kV/cm.

Modern bulk ferroelectrics known in the art, such as barium strontium titanate ($Ba_xSr_{1-x}TiO_3$, or BST), with ∈ roughly 500, have a high enough electric breakdown strength (100-200 kV/cm) and do not require an overly large bias electric field, instead operating at around 20-50 kV/cm. These bulk ferroelectrics can effect a 20-30% change in ∈, with a loss tangent of a sample of these materials of about $1.5\times10^{-3}$ at 1 GHz.

Using a modified bulk ferroelectric based on a composition of BST ceramics, magnesium compounds, and rare-earth metal oxides, one embodiment of the present invention uses a ferroelectric with a relative permittivity ∈=500, and 20% change in permittivity for a bias electric field of 50 kV/cm. The loss tangent for this ferroelectric is about $4\times10^{-3}$ at 11 GHz, which corresponds to about $4\text{-}5\times10^{-4}$ at 1.3 GHZ, assuming the well-known linear dependence between loss tangent and frequency. The availability of this ferroelectric allows creation of an L-band high power RF phase shift controller with the peak power required. This ferroelectric is further described in "Frequency Dependence of Microwave Quality Factor of Doped $Ba_xSr_{1-x}TiO_3$ Ferroelectric Ceramics," found in Integrated Ferroelectrics, v. 61, the entirety of which is herein incorporated by reference.

Figure 11:
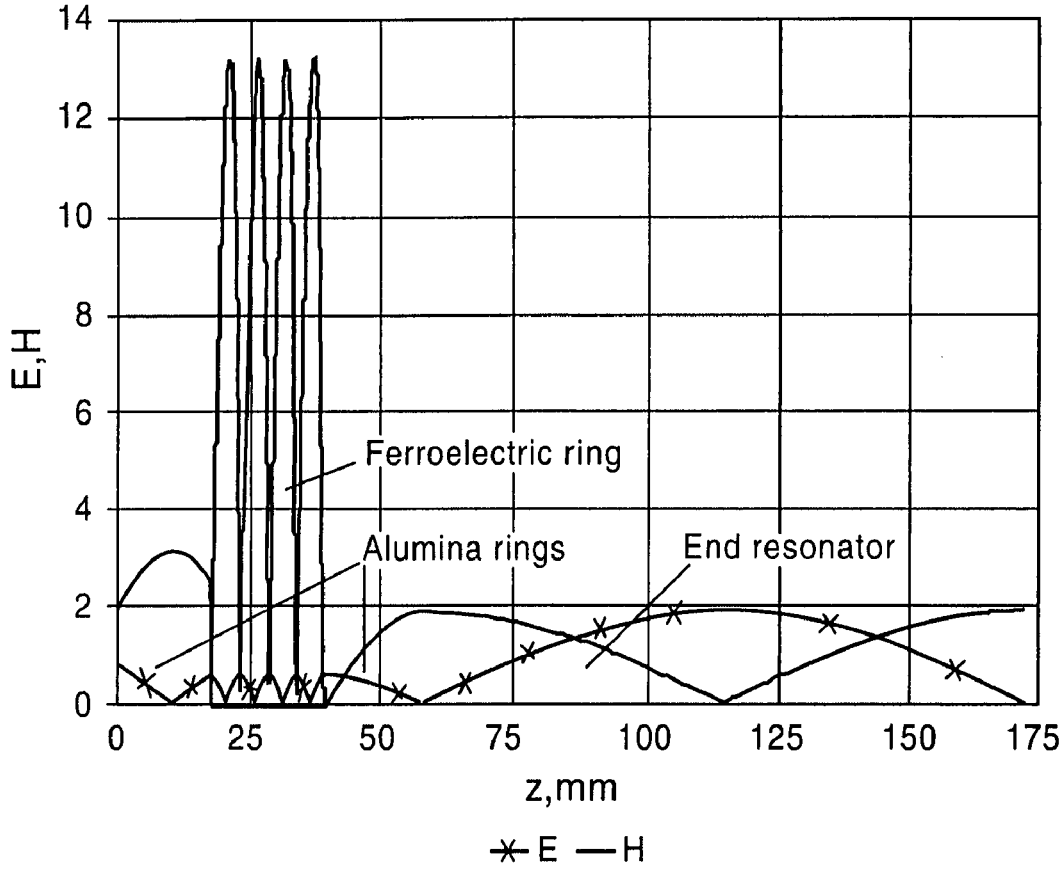
FIG. 11 illustrates the electrical and magnetic fields generated near the ferroelectric ring in an embodiment of the present invention.

FIG. 11 illustrates a calculated field profile along the coaxial phase shifter 850. The phase shifter 850 provides a phase change of 180 degrees when the bias voltage changes from 0 to 4.2 kV, and the dielectric constant changes from 500 to 470. The maximum bias electric field does not exceed 15 kV/cm. This value is still acceptable for non-vacuum device, but it would be desirable to reduce the peak field to the conventional level of 10 kV/cm. For the present design, the temperature rise is 0.3° C., an acceptable value. The temperature rise during the pulse (pulse heating) is 0.1° C. for specific heat of the chosen ferroelectric of 0.65 kJ/kg-K and density of $4.86\cdot10^3$ kg/m$^3$. This temperature rise, in turn, will lead to the phase deviation by 1.8 deg ($\partial\in/\partial T=3K^{-1}$ for the considered ferroelectric). All these small deviations as well as nonlinear effects can be easily compensated by the fast feedback system described in "First Results With A Fast Phase and Amplitude Modulator For High Power RF Applications," by D. Valuch, H. Frischholz, J. Tuckmantel, and C. Weil, the contents of which are incorporated entirely herein by reference.

With reference to FIG. 11, the electric (E) and magnetic (H) field amplitudes along the phase shifter 850 are normalized to the incident wave amplitude. Note that the normalized amplitude of the electric field in the ferroelectric ring 1010 is 0.63 compared to 2 in the air part of the phase shifter 850. The magnetic field increase in the ferroelectric ring 1010 leads to increased Ohmic losses on the metal wall, however these Ohmic losses are small, i.e., less than 2% of the incident power, or ~35 W in the given example.

Figure 12A:
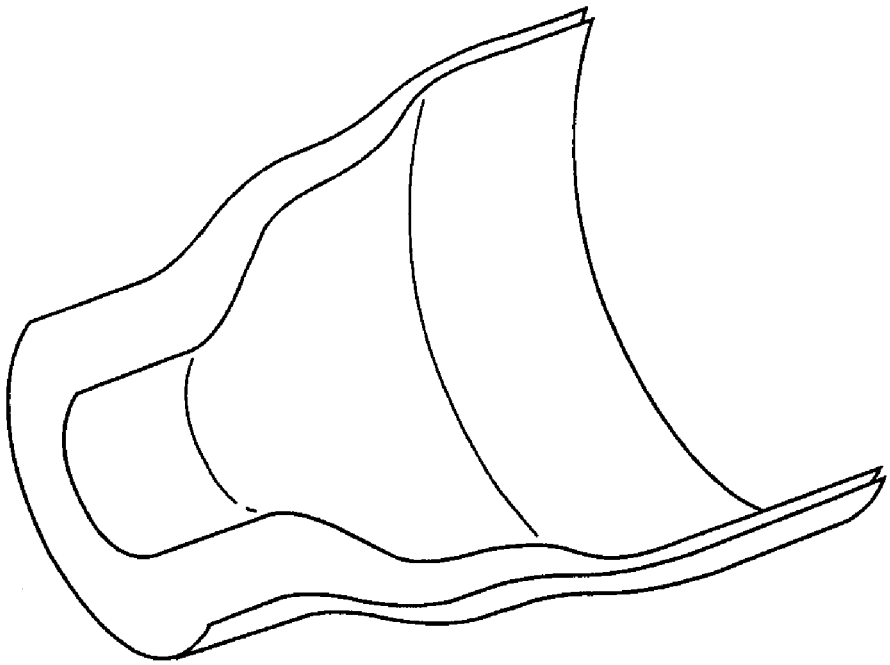
FIG. 12(*a*) represents a geometry of an impedance transformer in an embodiment of the present invention.
Figure 12B:
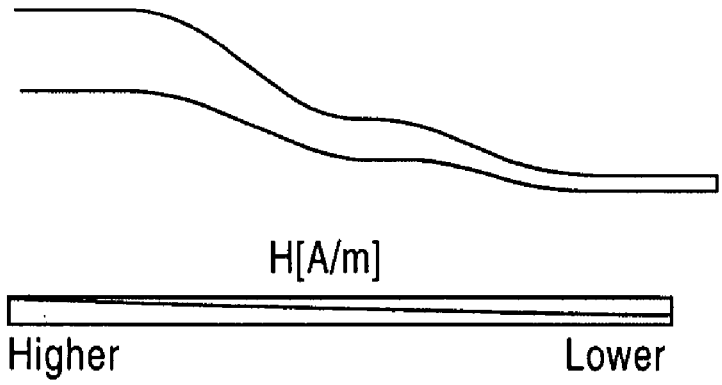
Figure 12C:
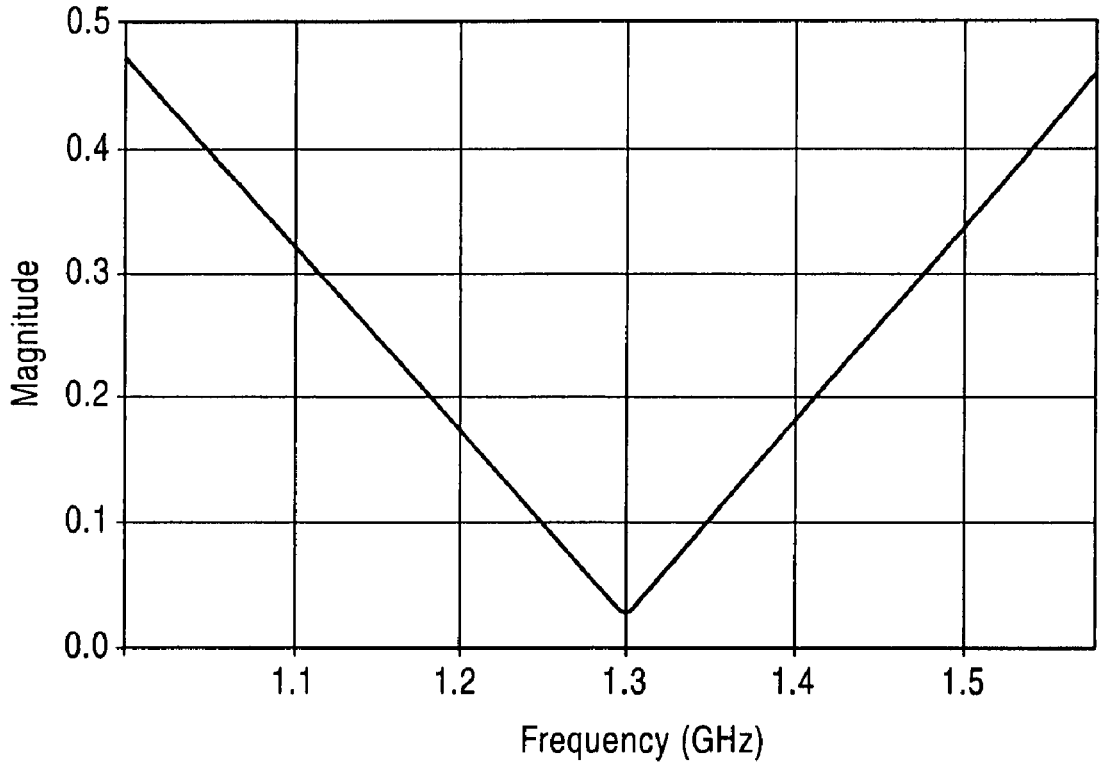

One embodiment of the ferroelectric phase shift controller 800 design includes waveguide-coaxial transformers for both phase shifters 850, 860, similar to one used in the TTF-III power coupler that is well known in the art. The coaxial impedance in TTF-III design is 50 Ohms. Thus, an impedance transformer from 50 Ohms to approximately 3 Ohms is required. FIG. 12(*a*) shows a design of an example transformer with the necessary transformer ratio. FIG. 12(*b*) shows the field pattern of the transformer illustrated in FIG. 12(*a*). FIG. 12(*c*) shows the calculated reflection magnitude over the frequency for the impedance transformer calculated S11 matrix.

The total capacity of the phase shifter 850 containing ferroelectric ring 1010 and alumina rings 1015 is 12.4 nF, and the total energy that should be supplied in order to create the bias voltage of 4.5 kV is 0.125 J. The charging time is less than 10 microseconds, and the pulse power is 12.5 kW. The average power (two switchings for each pulse) is 12 W only. For both phase shifters 850, 860 the average power should be very modest, 24 W. In an embodiment of the present invention, a possible schematic of the control system with a local feedback loop is shown in FIG. 13.

Figure 13:
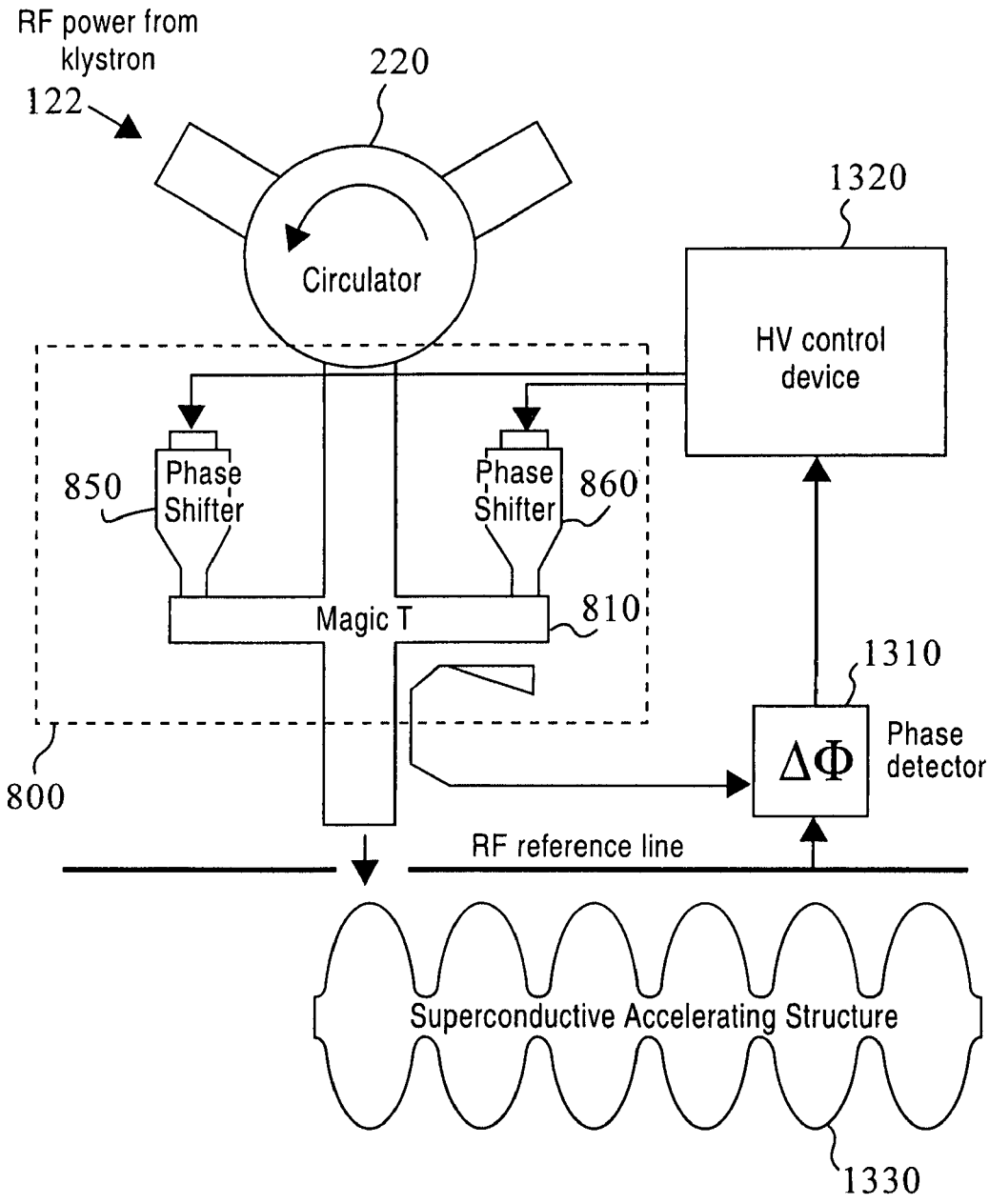
FIG. 13 is a diagram of a control unit used to control a fast ferroelectric phase shift controller in an embodiment of the present invention.

FIG. 13 describes a control system for controlling the phase shift controller 800. The ferroelectric phase shift controller 800 receives the RF power pulse from the circulator 220 and the waveguide transformer 24 and cavity input coupler 260 (not shown). The ferroelectric phase shift controller 800 then utilizes the two phase shifters 850, 860 and the magic T 810 to adjust the phase and amplitude of the transmitted wave, thus changing the coupling between the cavity and the RF power source, allowing the cavity in the superconductive accelerating structure 1330 to fill and drain more efficiently. The phase shifters, in addition to being calibrated based on the specifications of the superconductive accelerating structure, are also adjusted by a feedback loop in which phase detector 1310 detects the phase of the outputted RF power pulse, and transmits the information to the HV control device, which makes slight adjustments to the phase shifters based on the realized phase outputted by ferroelectric phase shift controller 800. In this manner, the phase can be adjusted precisely and the accelerating structure can compensate for real-world losses due to atmospheric conditions and other uncontrollable variables.

Figure 14:
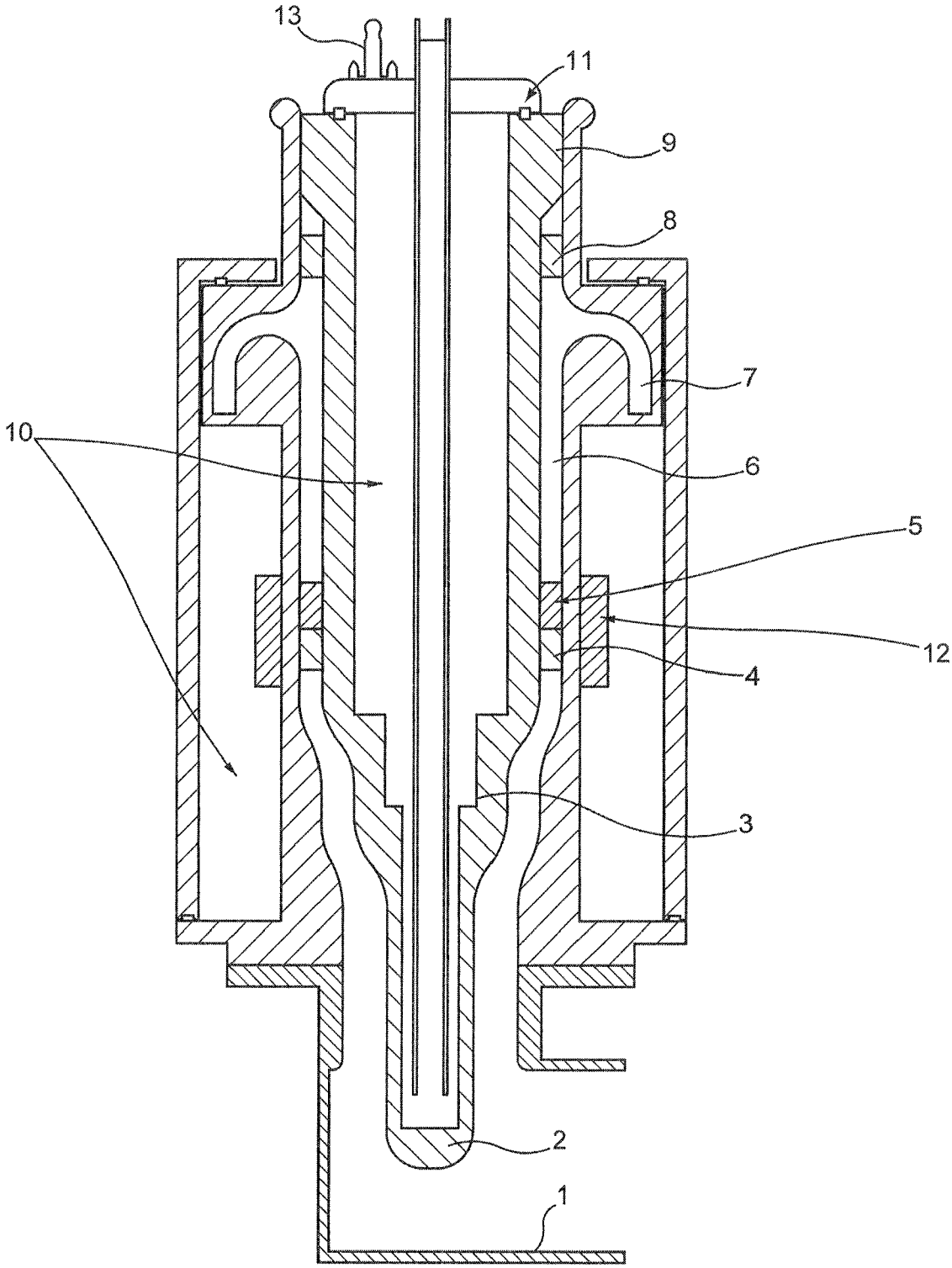
FIG. 14 illustrates a second embodiment of a phase shifter of the present invention.

One design concept for a second embodiment of the inventive ferroelectric L-band reflecting phase shifter suitable for high-power use is shown in FIG. 14. The phase shifter includes the waveguide-coaxial transformer 2 having a WR650 waveguide 1 to an 42 Ohm coaxial line (not shown) with an outer diameter of 80 mm; an impedance transformer 3 from 42 Ohms to 11 Ohms; a matching alumina ring 4 and a ferroelectric ring 5 in the coaxial line with an outer diameter of 120 mm and an internal diameter of 100 mm; and an end cavity 6 with an insulating choke 7 and a terminating alumina ring 8. Rubber gaskets can be provided between the end cap and the body of the transformer 3 with the HV connector 13 provided on the end cap. An absorber 9 is provided coaxially above the terminating alumina ring 8. Both internal and external parts of the phase shifters can be water cooled, by a water jacket 9, for example, in order to achieve temperature stabilization. FIG. 14 shows an internal heater 12 for temperature stabilization, but the heater can as well be external. Voltage bias to a maximum of 15 kV is to be applied to the central electrode which is electrically insulated from ground. As is known, the response time in ferroelectrics is very short and limited not by intrinsic ferroelectric properties, but by the time required for build-up of the biasing voltage. This built-up time is limited by the external circuit design and by the capacitance of the ferroelectric rings. In the present case, the overall capacitance of two rings is about 2.8 nF. Thus, in order to obtain a response time of less than 10 μs required for operation under ILC parameters, the high voltage pulser must supply a 15 kV pulse with a front that rises in <10 psec. This requirement could be met by commercially-available pulsers.

The phase shifter design shown in FIG. 14 requires metallization of the inner and outer cylindrical surfaces of the ferroelectric and alumina rings, together with a reliable means of brazing or otherwise firmly capturing the rings in the coaxial gap.

Figure 15:
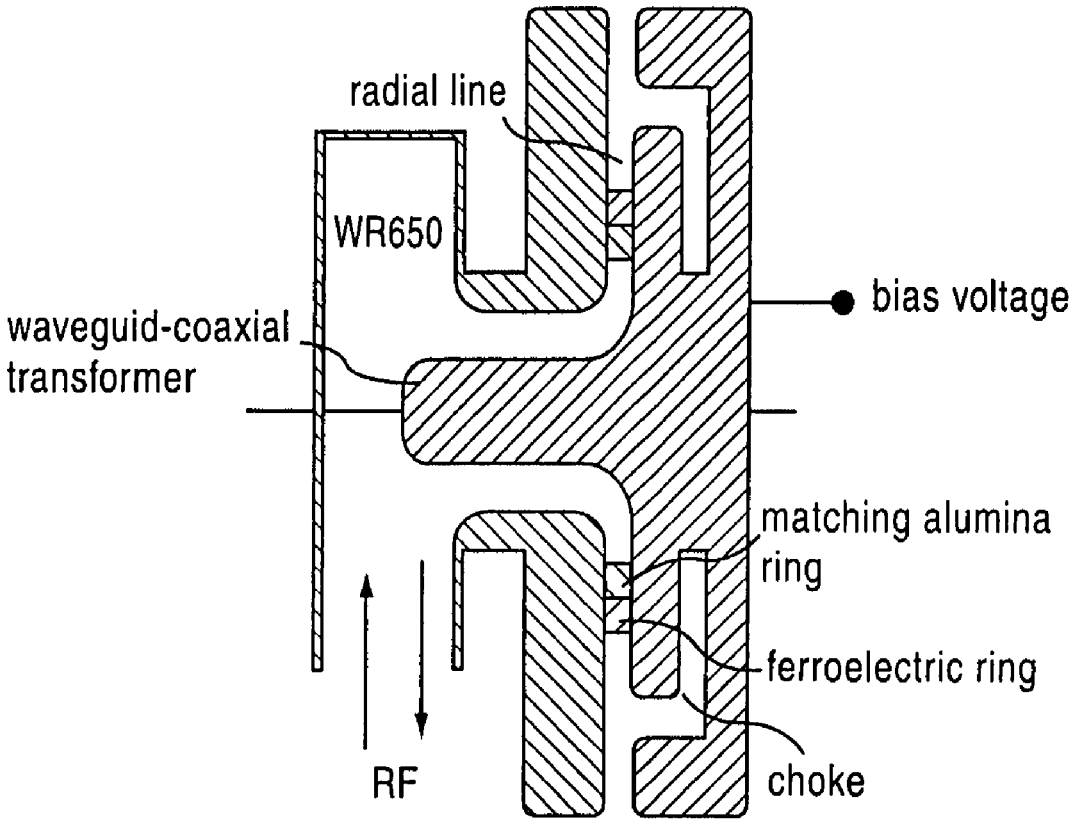
FIG. 15 is a diagrammatic view of a third embodiment of a phase shifter of the present invention.

FIG. 15 shows a third embodiment of the phase shifter concept employing a TEM radial line reflector, instead of a coaxial line reflector as in the design of FIG. 14.

That is, an alternative concept for the L-band ferroelectric phase shifter is based on use of a radial line reflector instead of the coaxial line reflector as depicted in FIG. 14. As can be seen in FIG. 15, this design requires metallization on the flat edges of the ferroelectric and alumina rings, rather than on the cylindrical surfaces; metallization on the flat edges is already well developed. Furthermore, assembly of the structure shown in FIG. 15 with either brazing or clamping of the rings between the planar surfaces of the two metallic elements is more straightforward than for cylindrical surfaces as in the structure shown in FIG. 14.

It is noted that, although the embodiments described above are calibrated for a specific linear particle accelerator, the ferroelectric phase shift controller should not be limited to these embodiments. The ferroelectric phase shift controller described herein can be applied to a multitude of superconductor cavities. For example, in some embodiments of the present invention, the ferroelectric phase shift controller will be adjusted to work in conjunction with superconductor cavities which operate at different frequencies than the above-described cavity. While the invention has been described in conjunction with specific embodiments therefor, it is evident that various changes and modifications may be made, and the equivalents substituted for elements thereof without departing from the true scope of the invention. In addition, many modifications may be made to adapt a particular situation or material to the teachings of the invention without departing from the scope thereof. Therefore, it is intended that this invention not be limited to the particular embodiment disclosed herein, but will include all embodiments within the spirit and scope of the disclosure.

What is claimed is:

1. A system for controlling a particle accelerating device comprising a:

a plurality of klystrons for generating RF power to be used by the particle accelerating device; and a plurality of delivery systems for delivering the RF power from the plurality of klystrons to a plurality of superconducting cavities, each delivery system further comprising:

a circulator which receives the RF power, wherein the circulator is operatively coupled to one of the plurality of klystrons;

a ferroelectric phase shift controller which receives the RF power from the circulator, and modifies at least one of a plurality of characteristics of the RF power, the ferroelectric phase shift controller having a waveguide coaxial transformer;

an impedance transformer;

a housing surrounding the impedance transformer, wherein an opening is formed between an inner surface of the housing and the outer surface of the impedance transformer;

a ferroelectric ring disposed in the opening between the inner surface of the housing and the outer surface of the impedance transformer; and a matching alumina ring disposed adjacent the ferroelectric ring, the matching aluminum ring being disposed in the opening between the inner surface of the housing and the outer surface of the impedance transformer; and a plurality of superconducting cavities operatively coupled to the waveguide transformer, wherein the plurality of superconducting cavities accelerate particles in the particle accelerating device.

2. The system according to claim 1, wherein the opening between the waveguide coaxial transformer and the housing in the ferroelectric phase shifter is a coaxial opening, and wherein the ferroelectric ring and the matching alumina ring are disposed coaxial to the waveguide transformer.

3. The system according to claim 2, wherein the ferroelectric ring and alumina rings are cylindrical, the phase shifter further including:

a metallization on the inner and outer surfaces of the ferroelectric ring and the alumina rings.

4. The system according to claim 1, wherein the opening in the ferroelectric phase shifter includes a radial opening between a planar surface of the waveguide coaxial transformer and the housing, and wherein the ferroelectric ring and the alumina ring are cylindrical rings having the flat surfaces of the cylinder facing the planar surface of the waveguide coaxial transformer and the planar surface of the housing.

5. The system according to claim 4, further comprising:

a metallization on the flat surfaces of the ferroelectric ring and the matching alumina ring.

6. A ferroelectric phase shifter comprising:

a waveguide coaxial transformer;

an impedance transformer;

a housing surrounding the impedance transformer, wherein an opening is formed between an inner surface of the housing and the outer surface of the impedance transformer;

a ferroelectric ring disposed in the opening between the inner surface of the housing and the outer surface of the impedance transformer; and a matching alumina ring disposed adjacent the ferroelectric ring, the matching aluminum ring being disposed in the opening between the inner surface of the housing and the outer surface of the impedance transformer.

7. The ferroelectric phase shifter according to claim 6, wherein the opening between the waveguide coaxial transformer and the housing is a coaxial opening, and wherein the ferroelectric ring and the matching alumina ring are disposed coaxial to the waveguide transformer.

8. The ferroelectric phase shifter according to claim 7, further comprising:

an end cavity formed in the coaxial opening between the impedance transformer and the housing; and a terminating alumina ring disposed between the inner surface of the housing and the outer surface of the impedance transformer, coaxial to the impedance transformer, wherein a side of the end cavity is formed by the terminating alumina ring.

9. The ferroelectric phase shifter according to claim 8, wherein the end cavity further comprises an insulating choke.

10. The ferroelectric phase shifter according to claim 8, wherein the coaxial transformer is configured with a central opening for receiving a temperature transferring material, and wherein the housing is configured with a central opening to for receiving a temperature transferring material.

11. The ferroelectric phase shifter according to claim 10, wherein the temperature transferring material is water.

12. The ferroelectric phase shifter according to claim 10, further comprising a heater.

13. The ferroelectric phase shifter according to claim 8, wherein the ferroelectric ring and alumina rings are cylindrical, the phase shifter further comprising:

a metallization on the inner and outer surfaces of the ferroelectric ring and the alumina rings.

14. The ferroelectric phase shifter according to claim 13, wherein the ferroelectric ring and the alumina rings are brazed in the coaxial opening.

15. The ferroelectric phase shifter according to claim 6, further comprising:

an HV connector opposite the waveguide coaxial transformer.

16. The ferroelectric phase shifter according to claim 6, wherein the opening includes a radial opening between a planar surface of the waveguide coaxial transformer and the housing, and wherein the ferroelectric ring and the alumina ring are cylindrical rings having the flat surfaces of the cylinder facing the planar surface of the waveguide coaxial transformer and the planar surface of the housing.

17. The ferroelectric phase shifter according to claim 16, further comprising:

a metallization on the flat surfaces of the ferroelectric ring and the matching alumina ring.

18. The ferroelectric phase shifter according to claim 17, wherein the ferroelectric ring and the matching alumina ring are clamped between the planar surfaces of the waveguide coaxial transformer and the housing.

19. The ferroelectric phase shifter according to claim 17, wherein the ferroelectric ring and the matching alumina ring are brazed between the planar surfaces of the waveguide coaxial transformer and the housing.

20. The ferroelectric phase shifter according to claim 17, further comprising:

a choke formed in the planar surface of the waveguide coaxial transformer.

* * * * *